United States Patent [19]

Scholz et al.

[11] Patent Number: 4,542,299

[45] Date of Patent: Sep. 17, 1985

[54] INFRARED SIMULATOR

[75] Inventors: Stefan Scholz, Alzenau; Egon Tyssen, Hofheim, both of Fed. Rep. of Germany

[73] Assignee: Honeywell Inc., Minneapolis, Minn.

[21] Appl. No.: 627,168

[22] Filed: Jul. 2, 1984

[30] Foreign Application Priority Data

Jul. 8, 1983 [DE] Fed. Rep. of Germany ..... 3324633

[51] Int. Cl.[4] ..... H01J 1/54

[52] U.S. Cl. ..... 250/504 R; 250/493.1; 250/252.1

[58] Field of Search ..... 250/493.1, 494.1, 495.1, 250/504 R, 333, 252.1; 313/466, 479, 480; 358/113

[56] References Cited

U.S. PATENT DOCUMENTS 4,178,514 12/1979 Bly ..... 250/493.1

4,299,864 11/1981 Bly ..... 250/493.1

*Primary Examiner*—Alfred E. Smith

*Assistant Examiner*—Jack I. Berman

*Attorney, Agent, or Firm*—George W. Field

[57] ABSTRACT

An infrared simulator serves to directly transduce electron beams into infrared radiation. To this purpose a modified cathode-ray tube is provided which includes an infrared transmissive window. Behind this window a film within the vacuum of the cathode-ray tube is arranged in order to transduce the electron bombardment into infrared radiation.

5 Claims, 2 Drawing Figures

INFRARED SIMULATOR

Figure 1:
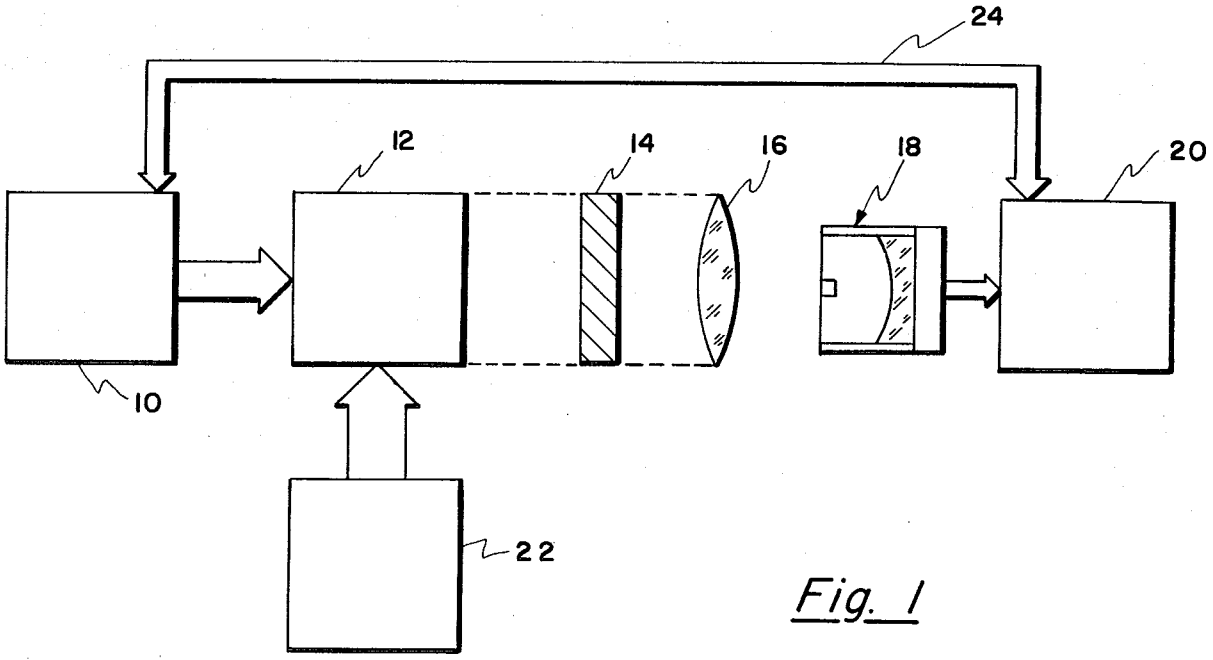

The present invention relates to an infrared simulator.

Infrared systems are increasingly being used, particularly in the military field. With the advancing automation of weapon systems such infrared devices are used more and more for target recognition or descrimination. Such devices often show a complicated optoelectronic design which comprises, besides one or a plurality of infrared sensors, electronic circuits which perform the analog and digital processing of the infrared sensor signals. Therefore an important need in the development of such so-called intelligent sensors, besides the optimization of the optical and electrical parameters, also consists in the development of an appropriate evaluation method for the sensor signals. In the use of real thermal targets the evaluation method usually is subject to a high expenditure of time, personnel and costs. Therefore, the alternative of simulation already has begun in order to test infrared sensors by means of thermal images.

Such a simulator is known from U.S. Pat. No. 4,178,514. In the known simulator visible images of a target are produced by means of a cinema or video projector, respectively, or on the screen of a cathode-ray tube. Those visible images are projected onto a transducer film which transduces the visible light into thermal radiation in the far infrared range. A layer of metallic blacks on a thermal isolating supporting layer, as for instance of polymer substrate, serves as a transducer film.

Departing from the known simulator, it is the object of the present invention to simplify it and to make its design less complicated by obviating the production of a visible image.

The present invention in particular makes use of the discovery that the transducer film known from U.S. Pat. No. 4,178,514 is capable of transducing electron bombardment at an appropriate energy level directly into radiation in the infrared range. In this way an infrared-television monitor may be designed, the distinction of which over an ordinary television monitor consists in that its face is transmissive to infrared radiation and that the usual phosphor layer which normally produces the visible image is replaced by a film which transduces the electron beams into infrared radiation. This film is arranged within the vacuum in apposition to the plate transmissive to infrared radiation.

With respect to embodiments shown in the attached drawing, the invention will be further explained in the following. In the drawing, FIG. 1 shows the design of a simulation and test device; and FIG. 2 shows the design of a specific infrared simulator.

Figure 2:
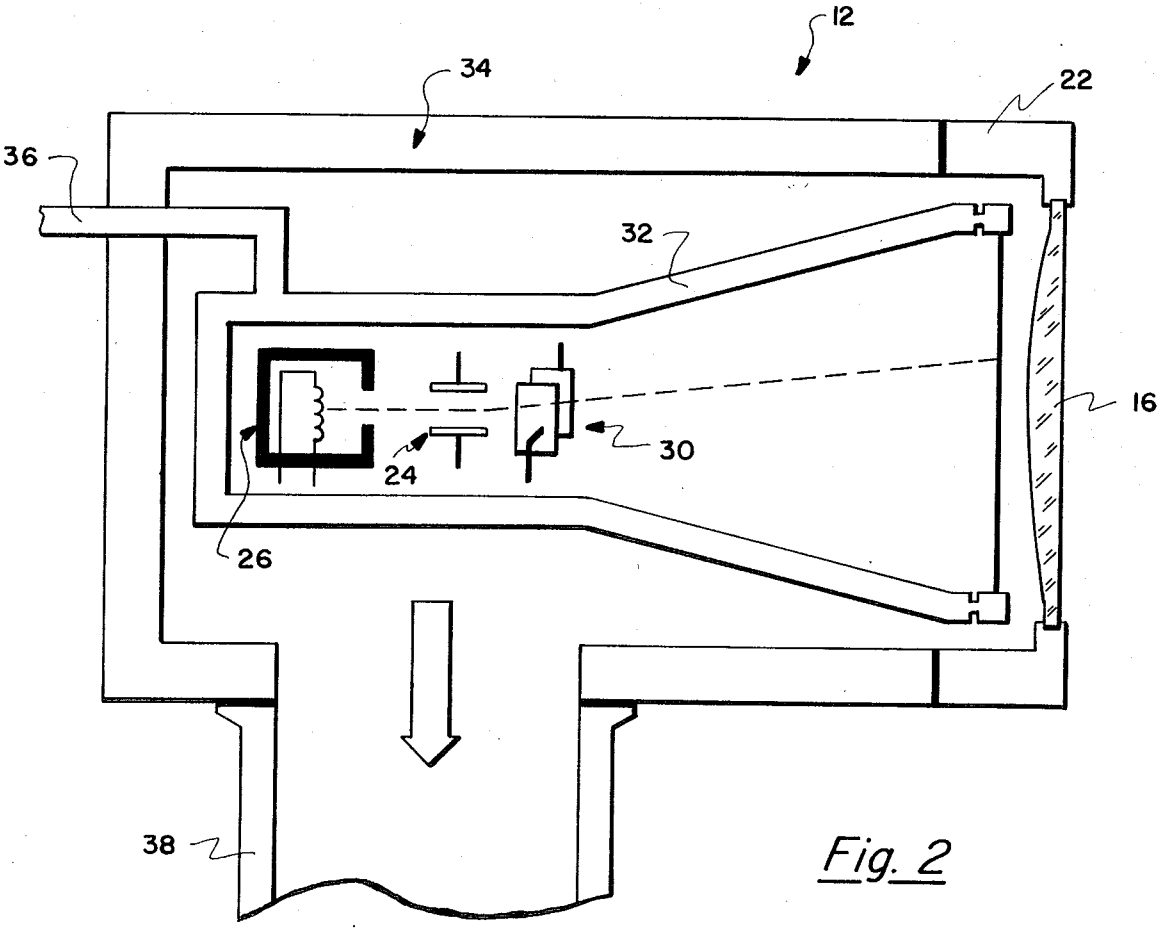

According to FIG. 1, a process control computer 10 having a data memory controls an electron scanner 12 according to a predetermined program in order to control the intensity of the produced electron beam and its deflection. The electrons impinge on a transducer film 14 which transduces the electron bombardment into radiation in the far infrared range. The control of the electron scanner 12, by means of the process control computer 10 and the subsequent infrared conversion enables the production of artificial as well as natural infrared signatures.

The transducer film 14 in its design is known from the above referenced U.S. patent. It has been found that at an exposure of the transducer film 14 with an electron pattern structured in its intensity the electron energy is transduced into thermal energy on the film so that a two-dimensional temperature distribution arises which comprise the infrared image to be simulated. The thermal energy in a point-focal imagery is directly delivered as infrared radiation.

The most important characteristics of the transducer film 14 are as follows:

(a) Small thickness, i.e. small mass per square unit for improvement of efficiency (achieved temperature difference per irridiated primary energy) and for improvement of dynamics (reduction of the timing constant), (b) mechanical stability by means of a two layer design, i.e. providing a supporting layer, e.g. from cellulose nitrate for the specific transducer layer, and (c) high thermal emissivity by use of a layer of metallic blacks which essentially influences temperature resolution of the film.

In the subject system, in contrast to the known system, temperature distribution is produced by means of a monochromic electron beam. In order to optimize efficiency, it is necessary to match the electron energy to the thickness of the film, i.e. scaling of the range of transmission of the electrons within the film in such a way that those electrons are nearly completely absorbed. In the use of gold blacks and of electrons with an energy of 0,5 to 6 keV, a practical range of transmission of the electrons (90% absorption) of 30 to 1340 Å results. Herewith essentially stimulation and ionization of shell electrons as well as generation of deceleration radiation in the field of the core or the shell, respectively, form the interaction mechanisms. The efficiency with respect to the generation of X-radiation is approximately $10^{-5}$ so that practically the total primary energy is converted into thermal energy.

In order to produce a randomly structured temperature distribution, the electron beam is deflected and modulated in its intensity. With respect to power density of the primary radiation, one may calculate from the thermal parameters of the film a value of 2 $mW/cm^2$ per degree of increased temperature. For an acceleration voltage of the electrons of 5 kV, a film diameter of 7,5 cm and for a maximum temperature difference of 70° C. one needs a tube with an input power of 6 Watt. The timing constant for temperature changes essentially depends on the ratio of the thermal capacity of the surface to the emissivity of the film. Timing constants in the range of 20 to 40 ms are attainable.

An adaptation optics 16 arranged behind transducer film 14 consists of a lens of material transmissive to infrared energy in a wide band, as for instance ZnSe, Ge, etc.

The electron scanner 12, the transducer film 14 and the adaptation optics 16 are integrated within a common housing which is shown in further details in FIG. 2. In FIG. 1 this is indicated by means of a periphery 22 for image generation, this periphery also including the high voltage supply and the cooling of a cathode-ray tube as well as a vacuum system. The transducer film 14 and the electron scanner 12 form one unit which is arranged within a vacuum of, for instance, $10^{-6}$ Torr. The vacuum system on one hand is required for the operation of the cathode-ray tube and on the other hand it protects the transducer film 14 from mechanical damage and improves temperature stability over the surface of the film since thermal losses due to atmospheric convection are greatly reduced.

The adaptation optics 16 images the infrared signature of the transducer film 14 according to the size of the real thermal target onto an infrared sensor 18 to be tested. The signals of the infrared sensor 18 are fed to an interface 20 which digitizes and multiplexes the applied signals in order to feed them via a bus 24 to the process control computer 10 for recording.

According to FIG. 2, the electron scanner 12 together with its periphery 22 is shown in further detail. The electron scanner 12 consists of a modified cathode-ray tube. This tube comprises, in the usual manner, a source 26 for producing an electron beam modulated in its intensity, in which means are provided to focus said electron beam. Furthermore, pairs of vertical and horizontal deflection plates 24 and 30 are arranged to deflect the electron beam so as to produce an infrared signature after its impinging on the transducer film 14. The transducer film 14 forms the screen of the modified cathode-ray tube. Furthermore, a bulb 32 of the cathode-ray tube behind the screen is double-walled and a cooling fluid supplied at 36 from a source not shown circulates within this double-walled bulb for cooling the film 14 together with its suspension, which results in a greater temperature dynamic of the film.

The electron scanner 12, i.e. the modified cathode-ray tube, is arranged within a housing 34 which is connected at 38 a a vacuum pump, not shown. It is desirable that the pressure within bulb 32 be the same as that in housing 34. The evacuated housing 34, at its front side adjacent to the transducer film 14, is closed by the infrared transmissive window 16 which preferably is designed as an adaptation optics for the infrared sensor arranged in front of the window and to be tested.

The embodiments of the invention in which an exclusive property or right is claimed are defined as follows:

1. Infrared simulator comprising an evacuated cathode-ray tube having a window transmissive to infrared radiation and a film behind the window and within the vacuum of the cathode-ray tube, said film primarily transducing electron bombardment into infrared radiation.

2. Infrared simulator according to claim 1, in which the film forms the screen of a cooled cathode-ray tube and the cathode-ray tube is inserted in an evacuated housing closed by said window.

3. Infrared simulator according to claim 1 or 2, in which the bulb of the cathode-ray tube as well as the suspension of the film are connected to a cooling circuit in order to improve temperature dynamics of said film.

4. Infrared simulator according to one of claims 1 or 2 characterized in that the window at the same time forms an adaptation optics for an infrared sensor to be tested.

5. Infrared simulator according to one of claims 1 or 2, characterized by a process control computer with a data memory to modulate the intensity and to deflect the electron beam of the cathode-ray tube and to evaluate the infrared image signals delivered from an interface to which the infrared sensor is connected.

* * * * *

UNITED STATES PATENT AND TRADEMARK OFFICE

CERTIFICATE OF CORRECTION

PATENT NO. : 4,542,299

DATED : September 17, 1985

INVENTOR(S) : Stefan Scholz and Egon Tyssen

It is certified that error appears in the above-identified patent and that said Letters Patent is hereby corrected as shown below:

One the Title Page;

INID Code 73, change Assignee "Honeywell Inc." to--Honeywell G.m.b.H.--.

Signed and Sealed this

*Seventeenth* Day of *December 1985*

[SEAL]

*Attest:*

DONALD J. QUIGG

*Attesting Officer*

*Commissioner of Patents and Trademarks*